United States Patent [19]

Börger

[11] Patent Number: 5,026,253

[45] Date of Patent: Jun. 25, 1991

[54] BELT-DRIVEN WATER PUMP

[75] Inventor: Herbert Börger, Heidelberg, Fed. Rep. of Germany

[73] Assignee: Firma Carl Freudenberg, Weinheim/Bergstr., Fed. Rep. of Germany

[21] Appl. No.: 355,174

[22] Filed: May 22, 1989

[30] Foreign Application Priority Data

Jul. 5, 1988 [DE] Fed. Rep. of Germany ..... 3822702

[51] Int. Cl.[5] ..... F01D 25/16

[52] U.S. Cl. ..... 415/229; 384/573; 403/329; 415/170.1

[58] Field of Search ..... 415/229, 230, 216.1, 415/170.1, 214.1; 384/573; 416/204 R; 403/329

[56] References Cited

U.S. PATENT DOCUMENTS

| | | | |
|---|---|---|---|
| 3,274,799 | 9/1966 | Danner | 415/216.1 |
| 3,399,911 | 9/1968 | Reisch | 403/329 |
| 3,536,412 | 10/1970 | Beare et al. | 415/200 |
| 3,871,790 | 3/1975 | Rameau | 415/214.1 |
| 3,981,610 | 9/1976 | Ernst et al. | 415/230 |
| 4,632,576 | 12/1986 | Neal | 384/537 |
| 4,643,646 | 2/1987 | Hahn et al. | 416/241 A |
| 4,715,780 | 12/1987 | Kan | 415/230 |
| 4,808,076 | 2/1989 | Jarmon et al. | 416/241 A |

FOREIGN PATENT DOCUMENTS

| | | | |
|---|---|---|---|
| 1400620 | 7/1975 | United Kingdom | 415/229 |

*Primary Examiner*—John T. Kwon
*Attorney, Agent, or Firm*—Kenyon & Kenyon

[57] ABSTRACT

A belt-driven water pump for use with an internal combustion engine includes a pump shaft, a housing lid having an opening through which one end of the pump shaft extends, a bearing, a pump shaft seal, a pump rotor, and a pulley integrally formed with the pump shaft. The pump shaft and the pulley are made in one piece, preferably, of plastic.

15 Claims, 4 Drawing Sheets

BELT-DRIVEN WATER PUMP

BACKGROUND OF THE INVENTION

The invention relates generally to belt-driven pumps and, more particularly, to an improved belt-driven pump for circulating cooling water in an internal combustion engine, hereinafter referred to as a "water pump."

A water pump having a pump shaft, a housing lid through which the pump shaft extends, a pump shaft seal, a pump rotor and a pulley is known in the prior art. Such known pumps are made of a multiplicity of detachably connected metallic parts, which results in considerable manufacturing costs and large weights. Also, the durability and service life of these known pumps leave much to be desired.

SUMMARY OF THE INVENTION

The invention is directed to provision of a water pump that avoids the above-mentioned problems and disadvantages by providing a water pump having a lighter weight, lower manufacturing cost, and substantially longer service life than heretofore possible.

This is accomplished by provision of a belt-driven water pump for use with an internal combustion engine comprising a pump shaft, a housing lid having an opening through which one end of the pump shaft extends, a pump shaft seal for sealing the end of the pump shaft against the housing lid, a pump rotor connected to the other end of the pump shaft and a pulley integrally formed with the pump shaft as a single piece.

The integral pump shaft and pulley of the invention have several advantages. Besides reducing manufacturing costs, the detrimental effects that can occur from the relative shifting of the pieces of a multiple part assembly, which produces unbalanced shaft conditions, are reliably prevented. Use of the integral pump shaft and pulley of the invention to avoid these detrimental effects has noticeably increased the attainable service life of the pump.

In one embodiment of the invention the integral pump shaft and pulley assembly is formed from a single piece of polymer material. This enables the total weight of the water pump to be markedly reduced, which, of course, is of great advantage. Despite this beneficial weight reduction, the mechanical strength of integral pump shaft and pulley assembly is sufficient to handle all normally occurring stresses when the integral assembly is formed from a polymer material. If required, the mechanical strength may be increased further by use of polymer material that is reinforced with fibers uniformly distributed therein.

In the water pump of the invention, the pump shaft may be rotatably supported in the housing lid by means of an antifriction bearing, which at the same time secures the shaft against relative axial displacement. The pump shaft may be fixed to the inner ring of the bearing, while the outer ring may be fixed to the housing lid. In this arrangement, the pump shaft may be provided with a recess or blind hole coaxially extending through the pulley into the region adjacent the inner end of the inner bearing ring. In addition to achieving a weight reduction, the blind hole prevents backward or outwardly directed axial movement of the shaft relative to the bearing inner ring, even though the inner ring is fixed to the shaft by a simple interference fit and despite the use of a polymer material for the production of the shaft. In order to prevent relative axial movement between the antifriction bearing and the pump shaft in the inward direction, an axial stop surface for the inner ring of the antifriction bearing may be formed by a shoulder of the pulley. With this construction, installation of the pump is facilitated as the pump shaft may simply be pressed into the inner ring of the antifriction bearing and any subsequent relative axial movement of the bearing and shaft is thereby prevented.

In order to achieve the greatest mechanical strength of the pump shaft while using as little material as possible to reduce weight, it is advantageous to form the pump shaft with a step-wise enlarged outside diameter in the axial region of the blind hole. In this region, the wall thickness of the shaft can be relatively thin if the pump shaft is formed from a polymer material because axial displacement relative to the inner ring of the antifriction bearing is largely prevented by the existence of the above-described features.

A particularly long service life of the water pump of the invention can be achieved upon reversing the connections between the inner and outer rings of the antifriction bearing with the housing lid and the pump shaft, respectively. In this manner, the pump shaft may be supported by the pulley, which is attached to the outer ring of the antifriction bearing, and the antifriction bearing may be supported by attaching its inner ring to the housing lid. One advantage of this embodiment is that considerably improved heat removal via the pulley and the revolving V-belt may be achieved.

The housing lid of the invention may be formed from a polymer material, which is advantageous because it enables the antifriction bearing to be directly connected to housing lid during formation of the lid from the polymer material. Subsequent assembly of the antifriction bearing thereby can be obviated and the further advantage of particularly precise positioning between these parts is obtained. In addition, the durability of the connection is greatly enhanced.

The pump shaft of the invention may be sealed to the housing lid by a lip seal. The lip seal may be formed with an annular outer portion directly connected to the housing lid during formation of the housing lid from a polymer material. One advantage of this arrangement is that it obviates the use of an independent seal unit, which must then be separately assembled to the housing lid. The lip seal, which may be formed from an annular PTFE washer to facilitate manufacture, is curved forward to form a trumpet-like, cross sectional shape. The inner portion of the washer rests under elastic pretension against the outer circumference of the pump shaft. The pump shaft may be provided in the area of contact with the lip seal with means for protecting the outer circumference of the shaft to reduce local wear. Excellent protection may be achieved when the shaft is provided with a direct ceramic coating or a plasma polymerization on the outer circumference. Alternatively, use of a separate protective sleeve member formed of metal or other suitable material, may be employed. The sleeve member may be connected to the pump shaft during its formation and solidification. The advantages obtained thereby lie in a further reduction of manufacturing costs.

The pump shaft may be provided with a radially extending depression formed in at least one portion of its outer circumference and the pump rotor may be provided with at least one mounting projection that may be snapped into the depression. In this manner, a fixed connection in the axial and circumferential directions is obtained after the pump rotor is snapped onto the pump shaft. The connection is highly durable and precludes, to a very high degree, the detrimental effects resulting from unbalanced shaft conditions. With such a connection, speeds of up to 7,500 rpm readily can be achieved, especially when the pump rotor is formed from a polymer material produced by injection molding. In addition to excellent shape reproduction, injection molding yields a high-quality surface. These two features are important in avoiding cavitation problems, which limits the upward range of permissible speeds of a centrifugal pump.

To reduce overall pump length, it is advantageous to arrange at least the pump shaft bearing in an axial projection of the housing lid and form the pulley in a cup-like shape such that the running track portion of the pulley surrounds the axial projection and, hence, the pump shaft bearing. The axial centers of the running track of the pulley and the bearing may be arranged in the same radial plane of the pump shaft to advantageously avoid the occurrence of torques in the pump shaft bearing. The mechanical load on the pump shaft bearing and the housing lid thereby are given a certain amount of static relief.

Some of the advantages of the water pump of the invention lie in its simple manufacture, distinctly reduced weight and increased service life, which approximately conforms with the customary service life of internal gas-combustion engines. Premature replacement of the water pumps thereby is obviated in most cases with the water pump of the invention. Further features, advantages and embodiments of the invention are apparent from consideration of the following detailed description, attached drawings and appended claims.

DETAILED DESCRIPTION

Figure 1:
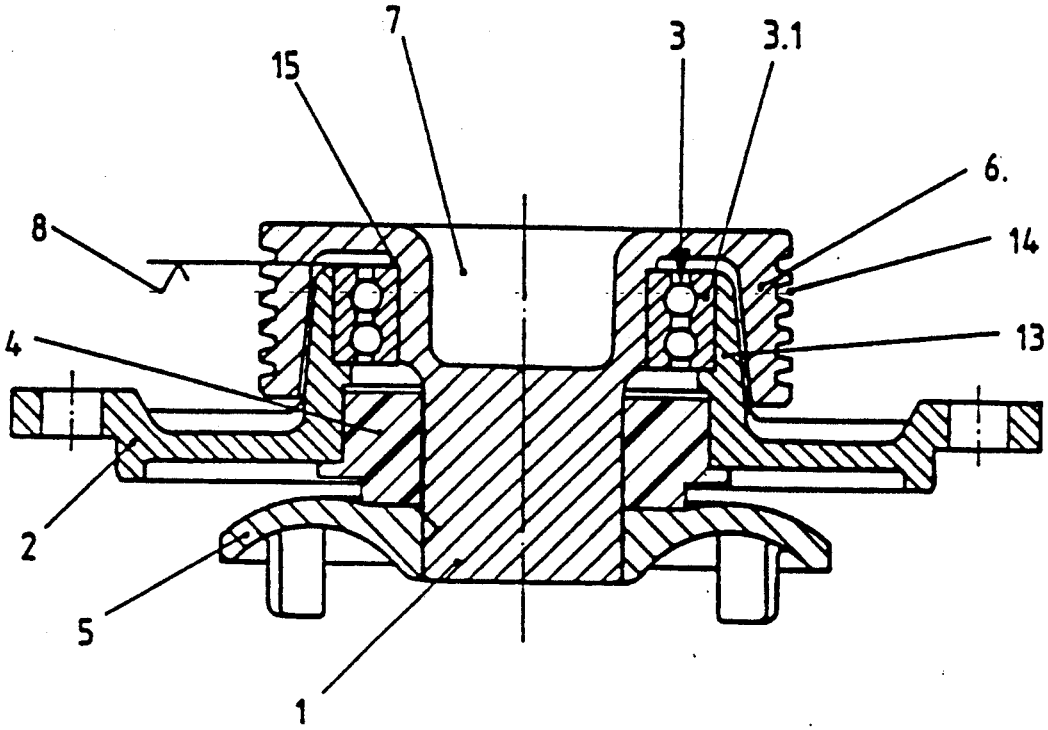
FIG. 1 shows a water pump constructed according to the principles of the invention in a longitudinal section view.

The Water pump shown in FIG. 1 comprises a pulley 6 integrally formed with a pump shaft 1, which may be injection molded from a polymer material. Pump shaft 1 is rotatably supported on an antifriction bearing 3 in housing lid 2 in an axially fixed manner. The housing lid 2 covers the end of a pump housing (not shown). Within the axial extent of antifriction bearing 3 along the longitudinal axis of the pump shaft 1, the pump shaft is provided with a blind hole or recess 7 that axially extends from the outer end of the pulley 6 into the region opposite the inner end of antifriction bearing 3. This region thereby has a comparatively higher pretension than the axially opposite end region. Subsequent to axially inward insertion of the pump shaft 1 into antifriction bearing 3, outward removal of shaft 1 in a backward direction is virtually impossible. Displacement of the shaft 1 in the opposite inward direction is prevented by shoulder 15 of pulley 6, which forms an axial stop surface 8.

In the axially center region of outer ring 3.1 of the antifriction bearing 3, a circular depression is provided into which the polymer material that forms the housing lid 2 can penetrate during the formation thereof. Solidification of the lid 2 produces a direct connection between ring 3.1 and lid 2 and relative displacement of these parts in the axial direction is prevented. In this manner, the pump shaft 1 and the pump rotor 5 attached thereto precisely maintain their radial and axial position with respect to the housing lid 2.

The antifriction bearing 3 is arranged in an axial projection 13 of housing lid 2 and the housing lid 2 is, in turn, surrounded by the running track surface 14 of the pulley 6. The axial centers of the antifriction bearing 3 and the running track surface 14 of the pulley are arranged in the same radial plane of the pump shaft 1. In this manner, any undesirable torques that may arise in the region of the antifriction bearing are avoided and great mechanical strength is achieved with a minimum of material. At the same time, the axial dimension of the pump is shortened to a minimum.

In the embodiment shown in FIG. 1, the seal 4 between the housing lid 2 and the pump shaft 1 comprises a stuffing gland packing. This seal may be replaced by a sliding-ring seal or another suitable conventional seal.

Figure 2:
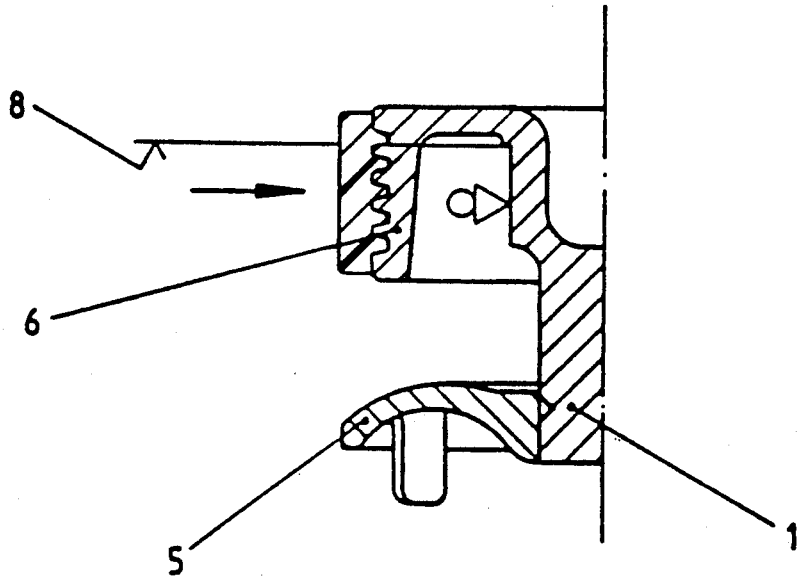
FIG. 2 shows the integral pump shaft and pulley of the water pump of FIG. 1 with the pump rotor in place.

In FIG. 2 the integral pump shaft and pulley of FIG. 1 is shown in an enlarged view to better illustrate the snap-on connection of rotor 5 and pump shaft 1. Axial displacement and rotation of rotor 5 relative the pump shaft 1 is prevented by the snap-on connection. Furthermore, the radially extending stop surface 8 can be seen in FIG. 2 within the pulley 6. Axial stop surface 8 abuts the inner ring of the antifriction bearing 3 when the water pump of the invention is assembled to precisely maintain the relative axial positioning between these two parts.

Figure 3:
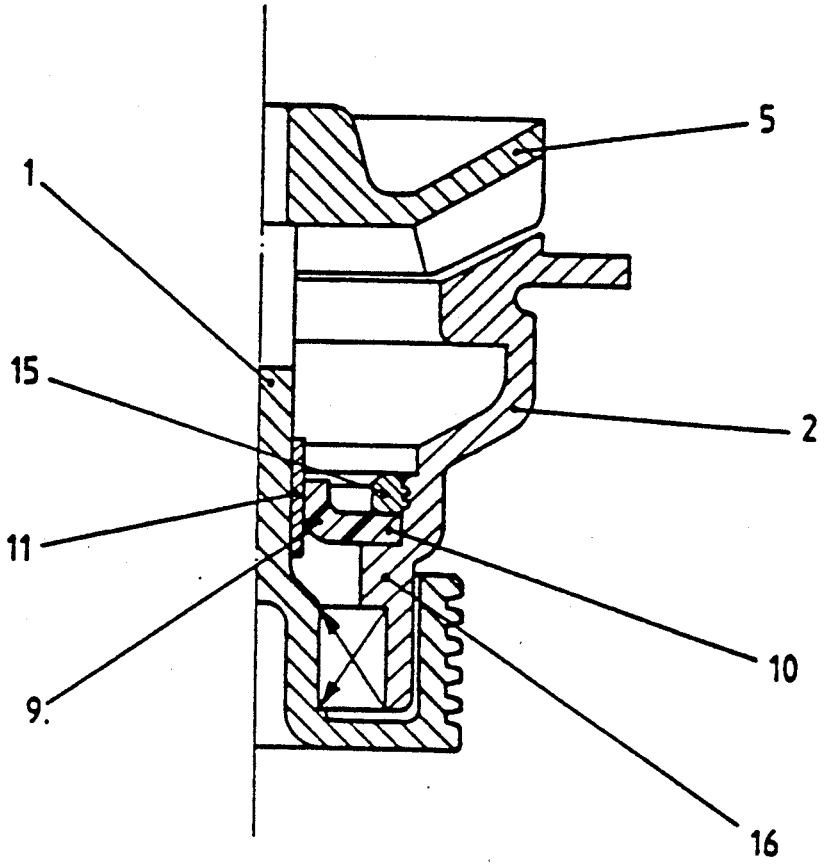
FIG. 3 shows an embodiment of the water pump, similar to FIG. 1, in which a lip seal is provided for sealing the housing lid against the pump shaft.

The water pump illustrated in FIG. 3 is similar to the FIG. 1–2 embodiment described above, but in this embodiment the rotor 5 is assembled onto shaft 1 in a reverse position from that shown in the FIG. 1–2 embodiment. A special application for this pump makes it necessary to form a major part of the pump housing itself within the pump lid 2. The pump lid therefore has a relatively enlarged annular space. Pump lid 2 is sealed against the pump shaft 1 by a lip seal 9. The lip seal 9 may comprise an annular washer, which may be formed of PTFE for manufacturing considerations, that bulges inwardly in the vicinity of its inside circumference during installation to form a trumpet-like cross sectional shape. Thus, lip seal 9 abuts the outside circumference of the pump shaft 1 under a radially-directed pretension. Pump shaft 1 is protected by sleeve 11, which may be formed of a metallic material, from the aggressive action of the lip seal 9. The protective sleeve 11 may have an elastic pretension for connection to the pump shaft by a pressure or interference fit, which secures the sleeve against rotation relative to shaft 1. Alternatively, the sleeve may be directly connected to the pump shaft during formation of the shaft from a polymer material. The lip ring 9 has a generally planar, annular portion 10 at its outer circumference for connection to lid 2. Portion 10 is secured in the axial direction between an inwardly facing annular shoulder 16 formed inside pump lid 2 and a tension ring 15, which is screwed into an internal thread of the pump lid 2. The lip seal ring 9 thereby is fixed in a liquid-tight and nonrotatable manner within the housing lid 2.

Figure 4:
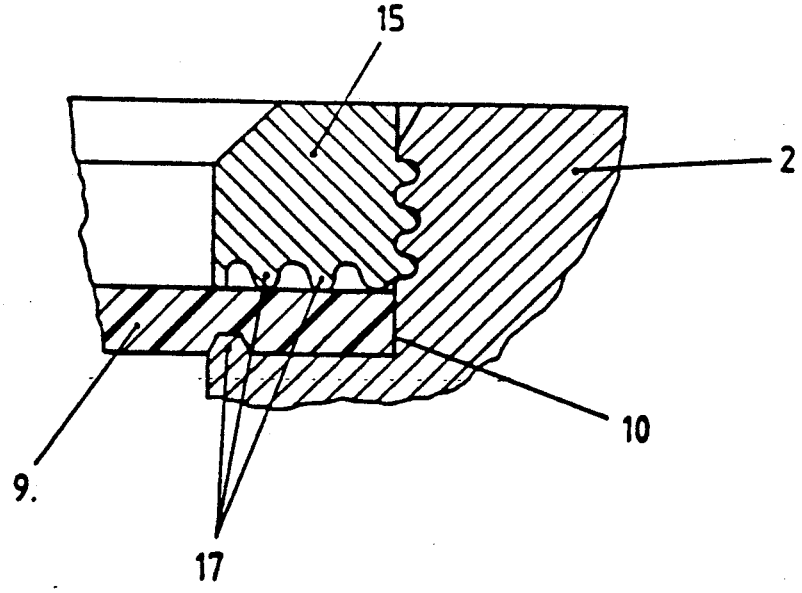
FIG. 4 shows an enlarged view of the connection between the lip seal and housing lid of the water pump of FIG. 3.

Further details of this connection are illustrated in FIG. 4, which illustrates concentric circular projections 17 provided at the lower boundary surface of the snap ring 15 for abutment with securing portion 10. Further concentric circular projections 17 can penetrate into the body material of the securing portion 10 from below under the action of the pretensioning forces. In this manner, good static fixation and sealing against the housing lid 2 is ensured.

Figure 5:
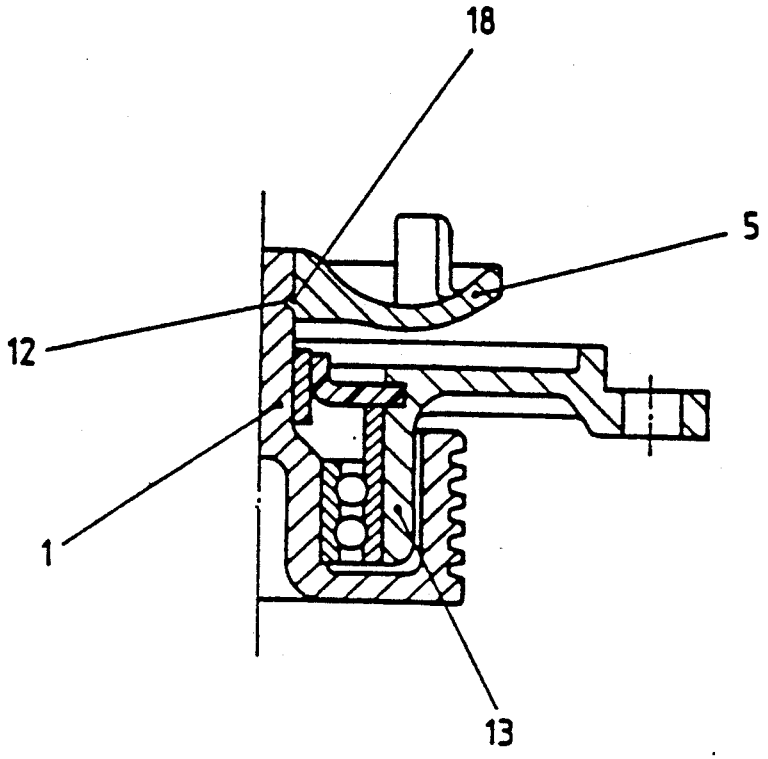
FIG. 5 shows a water pump, similar to the embodiment shown in FIG. 3, in which the housing lid is directly connected to the annular outer portion of the lip seal during formation of the lid from a polymer material.

In the embodiment shown in FIG. 5, the housing lid 2 may comprise a polymer material with the lid being directly formed around securing portion 10 of the lip seal 9. To obtain an especially good mutual seal and connection therebetween, the holding section may comprise PTFE that was first etched, preferably by using a solution of sodium in liquid ammonia. The resulting undetachable connection is simple to make and has an especially high durability.

In the FIG. 5 embodiment, the antifriction bearing 3 is arranged in an axial projection 13 of the housing lid 2. The outer ring of the bearing abuts the bottom or back side of the lip seal. This stiffens the axial projection 13 such that it can better withstand large belt forces. The pump rotor 5 is provided with a mounting projection 18 on the inner surface of its bore hole. projection 18 snaps into a suitably shaped circumferential recess formed in the pump shaft 1, as shown assembled in FIG. 5. The snap-on connection prevents rotation of the rotor 5 relative to shaft 1 and precisely locates the axial position of these parts. Cement or a similar substance may be used as an alternative or a supplement to the snap-on connection.

Figure 6:
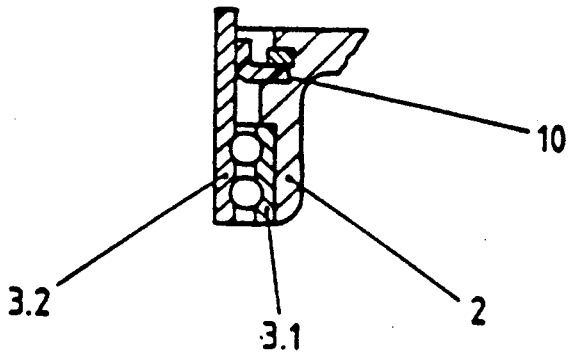
FIG. 6 shows a detail of a water pump, similar to the embodiment shown in FIG. 3, in which the housing lid is directly connected to the outer ring of the antifriction bearing during formation of the lid from a polymer material.

FIG. 6 illustrates a portion of a water pump constructed in a similar manner to the embodiment shown in FIG. 5. The housing lid 2 may comprise a polymer material that is directly formed around the holding section 10 of the lip seal and the outer ring 3.1 of the antifriction bearing. The inner ring 3.2 of the antifriction bearing axially extends to abut the seal. Inner ring 3.2 also forms a protective sleeve for the pump shaft 6 (not shown in FIG. 6), which subsequently may be inserted. The pump shaft may be made of plastic and may be connected to its associated pump rotor by a snap-on connection in a manner similar to that discussed above. Consequently, in this embodiment, final assembly of the water pump only requires the assembly of three parts. Such an embodiment thereby can be produced in a particularly economical manner and have an extremely long service life, while at the same time having a light weight. It also is resistant to aggressive or corrosive liquids and thereby is especially suitable for applications where this is critical.

Figure 7:
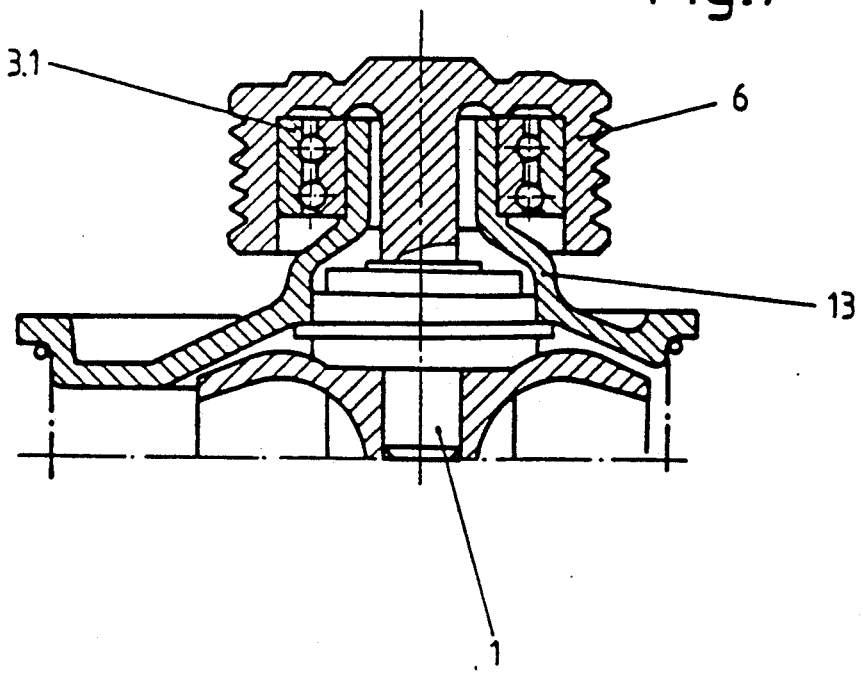
FIG. 7 shows an embodiment in which the pump shaft is supported on the outer ring of the antifriction bearing via the pulley.

In the embodiment of the invention shown in FIG. 7, the pump shaft 1 is supported on the outer ring 3.1 of the antifriction bearing by the pulley 6 integrally formed with the shaft 1. The inner ring of the antifriction bearing is located on the outer circumference of the axial projection 13 of the housing lid. The pump shaft 1 axially extends through the housing lid. In this embodiment heat removal is considerably improved due to the direct contact between the V-belt pulley 6 and the outer ring 3.1 of the antifriction bearing and the direct contact of the revolving V-belt that is in engagement with the V-belt pulley 6. The thermal load of the grease contained in the antifriction bearing is greatly reduced and the service life of the pump is substantially improved.

Figure 8:
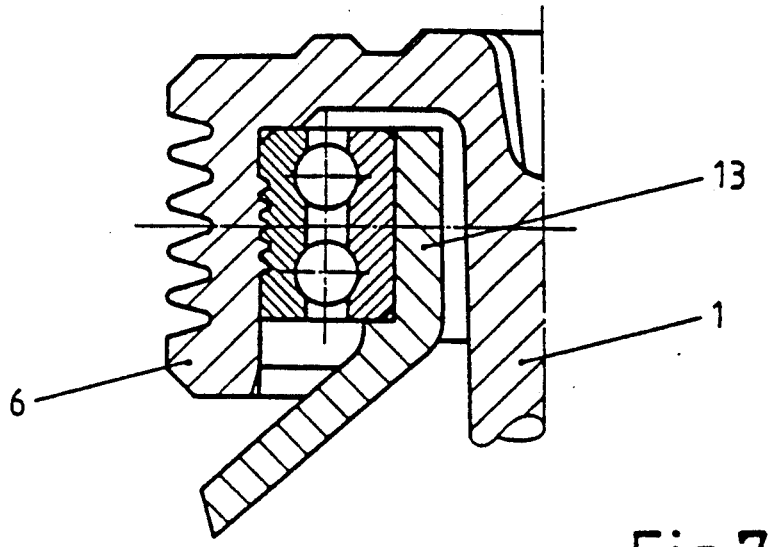
FIG. 8 shows a partial, enlarged view of the embodiment illustrated in FIG. 7.

In FIG. 8 an enlarged view of the antifriction bearing of the water pump of FIG. 7 is illustrated. The outer ring of the bearing is directly connected to the pulley during formation of the integral pulley 6 and pump shaft 1, which may comprise a polymer material. In this manner, the relative position between these parts cannot shift during use of the pump. The inner ring of the antifriction bearing may be press fit under pretension onto the axial projection 13 of the housing lid, which also may comprise a polymer material, to fixedly secure the inner ring. Also during long-term use of the pump, the relative position between the inner ring and projection 13 is fixed because the metallic material of the inner ring of the antifriction bearing only permits, under the continuous action of the resulting pretension, a small disturbing deformation of the polymer material forming the axial projection 13. The service life of such a water pump therefore is particularly long.

What is claimed is:

1. A belt-driven water pump for use with an internal combustion engine comprising:

a pump shaft;

a housing lid having an opening through which one end of the pump shaft extends;

a pump shaft seal for sealing the opening in the housing lid;

a pump rotor connected to the other end of the pump shaft;

a pulley integrally formed with the pump shaft as a single piece;

an antifriction bearing supported on an inner surface of the housing lid for rotatably supporting the pump shaft, said antifriction bearing having an inner ring connected to the pump shaft and an outer ring connected to the housing lid; and a recess in said one end of the pump shaft, said recess extending axially through the pulley into a region opposite an axially inner end of the inner ring of the antifriction bearing wherein said pump shaft is connected to the inner ring of the antifriction bearing by an interference fit between the recessed end of the pump shaft and the inner ring of the antifriction bearing, said interference fit preventing removal of said pump shaft from said antifriction bearing.

2. A belt-driven water pump according to claim 1 wherein the pump shaft and the pulley are formed from polymer material.

3. A belt-driven water pump according to claim 2 wherein the polymer material is reinforced with fibers uniformly distributed therein.

4. A belt-driven water pump according to claim 2 wherein the antifriction bearing is directly connected to the housing lid during formation of the housing lid from said polymer material.

5. A belt-driven water pump according to claim 2 wherein said pump shaft seal comprises a lip seal having an outer portion directly connected to housing lid during formation of the housing lid from said polymer material and an inner portion abutting an outer surface of the pump shaft.

6. A belt-driven water pump according to claim 5 wherein the lip seal comprises an annular PTFE washer having a curved middle section joining said outer portion and said inner portion, said outer portion being substantially perpendicular to the longitudinal axis of the pump shaft and said inner portion being substantially parallel to longitudinal axis of the pump shaft.

7. A belt-driven water pump according to claim 6 further comprising means for protecting the outer surface of the pump shaft adjacent the lip seal.

8. A belt-driven water pump according to claim 7 wherein said enclosing means comprises a protective sleeve.

9. A belt-driven water pump according to claim 8 wherein said protective sleeve is formed from metal and is directly connected to the pump shaft during the formation of the pump shaft from polymer material.

10. A belt-driven water pump according to claim 1 further comprising at least one depression formed in a portion of an outer circumference of the pump shaft and at least one mounting projection formed on the pump rotor for insertion into said at least one depression whereby the pump rotor may be snapped onto the pump shaft.

11. A belt-driven water pump according to claim 1 wherein said housing lid includes an axially extending projection, said antifriction bearing is supported on said axially extending projection and said pulley has a cup-shaped portion surrounding the axial projection of the housing lid that forms a running surface for connection to a drive belt.

12. A belt-driven water pump according to claim 11 wherein the axial centers of said antifriction bearing and said running surface are substantially aligned in a radial plane of the pump shaft.

13. A belt-driven water pump according to claim 1 wherein the antifriction bearing is supported on an inner surface of the housing lid.

14. A belt-driven water pump according to claim 13 further comprising a stop surface formed on the pulley axially locating the inner ring of the antifriction bearing and preventing inward displacement of the pump shaft.

15. A belt-driven water pump according to claim 14 wherein the pump shaft has first outer diameter at a portion of the shaft adjacent the pump rotor and a second outer diameter larger than the first diameter of a portion of the shaft adjacent the recess.

* * * * *